US011351597B2

(12) United States Patent
Dai et al.

(10) Patent No.: US 11,351,597 B2
(45) Date of Patent: Jun. 7, 2022

(54) INTELLIGENT RIVETING SYSTEM

(71) Applicant: MEISHAN CRRC FASTENING SYSTEM CO., LTD, Meishan (CN)

(72) Inventors: Guangcheng Dai, Meishan (CN); Tao Deng, Meishan (CN); Long Guo, Meishan (CN); Min Lei, Meishan (CN); Wei Li, Meishan (CN); Qiang Liu, Meishan (CN); Yu Liu, Meishan (CN); Tao Yu, Meishan (CN); Xin Zhang, Meishan (CN); Xiangyun Zhao, Meishan (CN)

(73) Assignee: MEISHAN CRRC FASTENING SYSTEM CO., LTD, Meishan (CN)

( * ) Notice: Subject to any disclaimer, the term of this patent is extended or adjusted under 35 U.S.C. 154(b) by 379 days.

(21) Appl. No.: 16/617,454

(22) PCT Filed: Sep. 17, 2018

(86) PCT No.: PCT/CN2018/105924
§ 371 (c)(1),
(2) Date: Nov. 26, 2019

(87) PCT Pub. No.: WO2019/192146
PCT Pub. Date: Oct. 10, 2019

(65) Prior Publication Data

US 2021/0121941 A1 Apr. 29, 2021

(30) Foreign Application Priority Data

Apr. 4, 2018 (CN) ..... 201810299920.6

(51) Int. Cl.
*B21J 15/28* (2006.01)
*B21J 15/20* (2006.01)
(Continued)

(52) U.S. Cl.
CPC ..... *B21J 15/285* (2013.01); *B21J 15/105* (2013.01); *B21J 15/20* (2013.01); *B21J 15/38* (2013.01)

(58) Field of Classification Search
CPC ..... B21J 15/285; B21J 15/105; B21J 15/20; B21J 15/38
(Continued)

(56) References Cited

U.S. PATENT DOCUMENTS 4,836,003 A * 6/1989 Blake ..... B21J 15/105 72/43
7,331,205 B2 * 2/2008 Chitty ..... B21J 15/28 72/21.4

(Continued)

*Primary Examiner* — Robert F Long
*Assistant Examiner* — Xavier A Madison
(74) *Attorney, Agent, or Firm* — Houtteman Law LLC

(57) ABSTRACT

An intelligent riveting system comprising a hydraulic riveting tool (1), a riveting position identification system, a riveting displacement detection system, a riveting pressure detection system and a central processing system, wherein the central processing system acquires image information and carries out position identification, encoding and storage to form riveting position data in one-to-one correspondence, acquires real-time displacement data and riveting oil pressure data of each riveting position to form real-time data corresponding to riveting displacement values and riveting pressure values, and compares same with a standard to carry out quality determination. By means of the intelligent riveting system, a riveting position and an installation parameter are automatically identified and acquired, and the riveting quality is automatically determined; and by means of storing data during riveting and installation, the traceability of rivet installation quality can be achieved.

9 Claims, 4 Drawing Sheets

(51) Int. Cl.
*B21J 15/38* (2006.01)
*B21J 15/10* (2006.01)

(58) Field of Classification Search
USPC ..... 227/2
See application file for complete search history.

(56) References Cited

U.S. PATENT DOCUMENTS

2005/0217097 A1* 10/2005 Solfronk ..... B21J 15/285
29/243.521
2007/0113390 A1* 5/2007 Chitty ..... B21J 15/043
29/243.523
2012/0006877 A1* 1/2012 Lee ..... B25C 1/008
227/2
2016/0144466 A1* 5/2016 Simonet ..... B23P 11/005
29/505

* cited by examiner

INTELLIGENT RIVETING SYSTEM

TECHNICAL FIELD

The present invention belongs to the technical field of riveting fastening, in particular to the technical field of design and manufacture of riveting fastening devices, and particularly relates to a pulling rivet fastening device system and the monitoring technology thereof, belonging to the riveting category (B21J).

BACKGROUND ART

The pulling rivet fastening technology has been widely applied in railway, aviation, automobile, ship and other industries. However, in the process of mass installation and use, due to the negligence of operators and inspectors, it is likely to cause such problems as missing rivets, missing detection or wrong detection, which brings great potential safety hazards to the operation of the system.

Chinese Patent No. 200680033854.3 Monitoring System for Fastener Placing Tool discloses a monitoring system for riveting fasteners, which provides a detection method of riveting displacement and riveting force by using a sensor. The structure and the monitoring method of the invention are as follows. A non-contact stroke-sensor is used to sense the distance between the tapering face of a adapter and a sensor, thus the adapter should be additionally arranged between a piston at the rear end of the riveting tool and a jaw assembly at the front end of the riveting tool, and moves with the piston and the jaw assembly. The structure for measuring the riveting force is that a load cell sensor senses the compressive force between the front and rear parts of the monitoring assembly body, thereby sensing the compressive load between the front nosepiece and the tool body; therefore, the monitoring assembly also needs to be additionally fitted between the rear tool body and the nosepiece. Except the front and the rear parts, three screws, a rear cover and the like are additionally included. The above-mentioned patent has the following defects that the monitoring system can be used only for break mandrel blind rivet fasteners and cannot meet the monitoring requirements for other non-break mandrel blind rivets; the monitoring system is less intelligent; the riveting position cannot be determined automatically; and the traceability after the rivet installation could not be achieved.

Chinese Patent No. 201510939835.8 Intelligent Riveting Monitoring Method and System discloses an intelligent riveting monitoring method and system. The structure and the monitoring method of the invention comprise arranging a draw wire, rod or laser displacement sensor on a riveter oil cylinder, with the body, the draw wire and the like respectively fixed on the oil cylinder and a piston; arranging a piezoelectric type pressure sensor between an oil outlet of a hydraulic pump and an oil inlet tube of the riveter, or arranging a through-shaft pressure sensor on the head part of the riveter; and arranging a camera device and a microcomputer processor on the surface of the oil cylinder, wherein the electric signal ends such the sensor, the camera and the like are connected with the microcomputer, and the outlet of the microcomputer is connected with an alarm; pre-arranging and inserting a pulling rivet, and then starting the riveter; acquiring images by the camera, and determining a riveting position point by the online identification program of the microcomputer; after riveting, inputting the measured displacement and pressure data; and determining whether the displacement, the riveting force and the position point are qualified or not, if yes, storing data, otherwise, alarming, thereby realizing automatic identification of the riveting position, riveting quality, system failure and failure alarm. Hidden danger such as missing riveting, missing detection or wrong detection and the like caused by negligence of people are effectively avoided. Various sensors are simple in mounting structure, are convenient to mount, and can be used for riveting monitoring for any pulling rivets. This patent solves such functions as automatic identification of the riveting position, primary quality monitoring and system failure alarm, but has deficiency on displacement detection and riveting data tracing.

SUMMARY OF THE INVENTION

The present invention provides an intelligent riveting device system, which aims to provide a comprehensive intelligent riveting device with the functions of automatic identification of riveting position, process installation parameters and quality, failure and error information alarm, data tracing and the like. The intelligent riveting device is simple in structure and installation, and also can be used for monitoring the riveting of various rivets.

The technical schemes adopted by the present invention are as follows.

An intelligent riveting system, comprising a hydraulic riveting tool, a riveting position identification system, a riveting displacement detection system, a riveting pressure detection system and a central processing system; which is wherein:

said hydraulic riveting tool comprises a riveting machine used for fixing a riveted piece through extruding a rivet, and a hydraulic pump station used for providing hydraulic riveting power for the riveting machine;

said riveting position identification system comprises an image acquisition device used for acquiring image information of each riveting position and transmitting the image information to the central processing system;

said riveting displacement detection system comprises a displacement detection device used for detecting real-time displacement data in the process of fixing the riveted piece through extruding the rivet by the riveting machine, and transmitting the real-time displacement data to the central processing system;

said riveting pressure detection system comprises a pressure sensor used for detecting real-time riveting oil pressure data of the hydraulic pump station in the riveting process and transmitting the real-time riveting oil pressure data to the central processing system; and said central processing system comprises an upper computer, wherein the upper computer acquires image information from the image acquisition device and carries out position identification, encoding and storage to form riveting position data in one-to-one correspondence; the upper computer acquires real-time displacement data from the riveting displacement detection system to form the real-time displacement data in a time-sequential manner, and stores the real-time displacement data; the upper computer acquires real-time riveting oil pressure data from the riveting pressure detection system to form the real-time pressure data in a time-sequential manner, and stores the real-time pressure data; and the upper computer records the position data, the displacement data and the oil pressure data as the real-time data corresponding to riveting displacement values and riveting pressure values with each riveting position as a unit and in the same time-sequential manner.

Said displacement detection device is a draw wire, rod or laser displacement sensor.

Said displacement detection device can further be a flowmeter arranged between an oil return port of the hydraulic pump station and a pressure oil outlet pipe of the riveting machine or arranged between an oil outlet of the hydraulic pump station and a pressure oil inlet pipe of the riveting machine. The flowmeter is used for acquiring the pressure oil flow signal of the oil outlet pipe of the riveting machine or the pressure oil flow signal of the oil inlet pipe of the riveting machine during riveting, and transmitting the flow signal data to the upper computer to obtain the riveting displacement data. According to the invention, the flowmeter is preferred to acquire the displacement data for the structure of the riveting system could not be changed by using the flowmeter, and the acquired data are stable, accurate and reliable. Meanwhile, the flowmeter can be conveniently connected when being applied to the transformation of existing equipment, and it is unnecessary to carry out complicate transformation on the existing riveting tools.

Said image acquisition device adopts a CCD (charge coupled device) industrial camera lens, a USB interface endoscope lens or a lens matched with a video capture card; the video lens of the image acquisition device is fixedly mounted at the top of the outer surface of the riveting device oil cylinder through a mounting seat and is aligned with the riveted piece at the front position; and a signal line is transmitted from between the rear end cover of the hydraulic riveting tool and the anti-loosening baffle via a handle.

Said central processing system compares the real-time data, corresponding to the riveting displacement values and the riveting pressure values with each riveting position as a unit in the same time-sequential manner, with a standard value range, recording these within the standard value range as qualified, otherwise recording as unqualified and sending a prompt message.

When the device of the invention is applied, after the hydraulic riveting tool is started, the image acquisition device takes pictures of the riveting position point, and the image data are transmitted to the image acquisition and analysis system of the upper computer of the intelligent pump station for analyzing and processing, thereby completing the determination of the riveting position point. The piston and the jaw of the hydraulic riveting tool apply tension to the rivet, and the oil cylinder and an anvil assembly apply thrust to the lantern ring, so as to enable the displacement of the rivet relative to the lantern ring and fasten the riveted piece. In the riveting process, the riveting displacement acquired by the sensor on the hydraulic riveting tool or flow pulse signal of the oil return port of the pump station is transmitted to the upper computer of the intelligent pump station to directly or indirectly calculate the riveting displacement, and the riveting force data sensed by the pressure sensor on the pump station is transmitted to the upper computer to calculate the riveting force, so as to obtain the real-time data corresponding to the riveting displacement values and the riveting pressure values with each riveting position as a unit in the same time-sequential manner, and generate a riveting force-riveting displacement relation curve. The riveting force-riveting displacement relation curve is compared and analyzed with the standard qualified curve (set as the standard value range) stored in the system to complete the determination of the riveting quality, recording these within the standard value range as qualified, otherwise recording as unqualified and sending a prompt message.

The beneficial effects of the invention are as follows.

1) The present invention provides a novel intelligent riveting device realizing such functions as automatic identification of riveting positions, adjustment of installation parameters, recording of parameter information in the riveting process, automatic detection and determination of the riveting quality, and error information prompt, which effectively avoids potential safety hazards caused by negligence of people. 2) According to the characteristics of different riveting positions, images of the riveting position points are acquired, and the actually acquired images are processed, in order to extract the image characteristics. Then the classification information is outputted by carrying out pattern identification on the characteristics by means of the classification standard or comparing the characteristics with the characteristic library, thereby identifying the riveting position points. The output of the position identification information can provide an effective method for further riveting quality monitoring. 3) The displacement sensor or the flowmeter and the pressure sensor, convenient to install, can realize on-line monitoring of riveting displacement and riveting force of the rivet. 4) The intelligent riveting device developed by the invention not only can be used for break mandrel blind rivet fasteners, but also for various types of non-break mandrel rivet fasteners such as Bobtail and reusable rivets to meet the product requirements. 5) By adopting the flowmeter, a more accurate real-time riveting displacement value can be acquired, the structure of the riveting device can be simplified, and the weight of the riveting device can be reduced. 6) According to the monitoring method of the invention, the storage of the data generated during riveting installation can realize the traceability of the pulling rivet installation quality.

Figure 1:
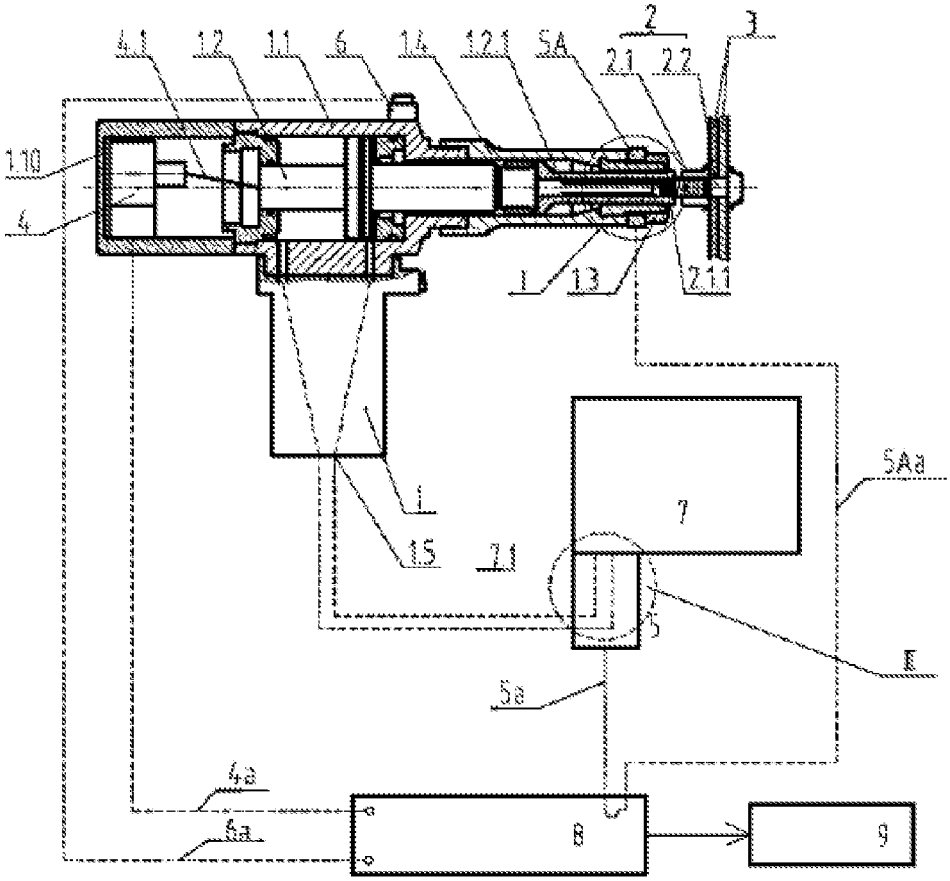
FIG. 1 is a schematic diagram showing the general composition and arrangement of the intelligent riveting monitoring system.
Figure 2:
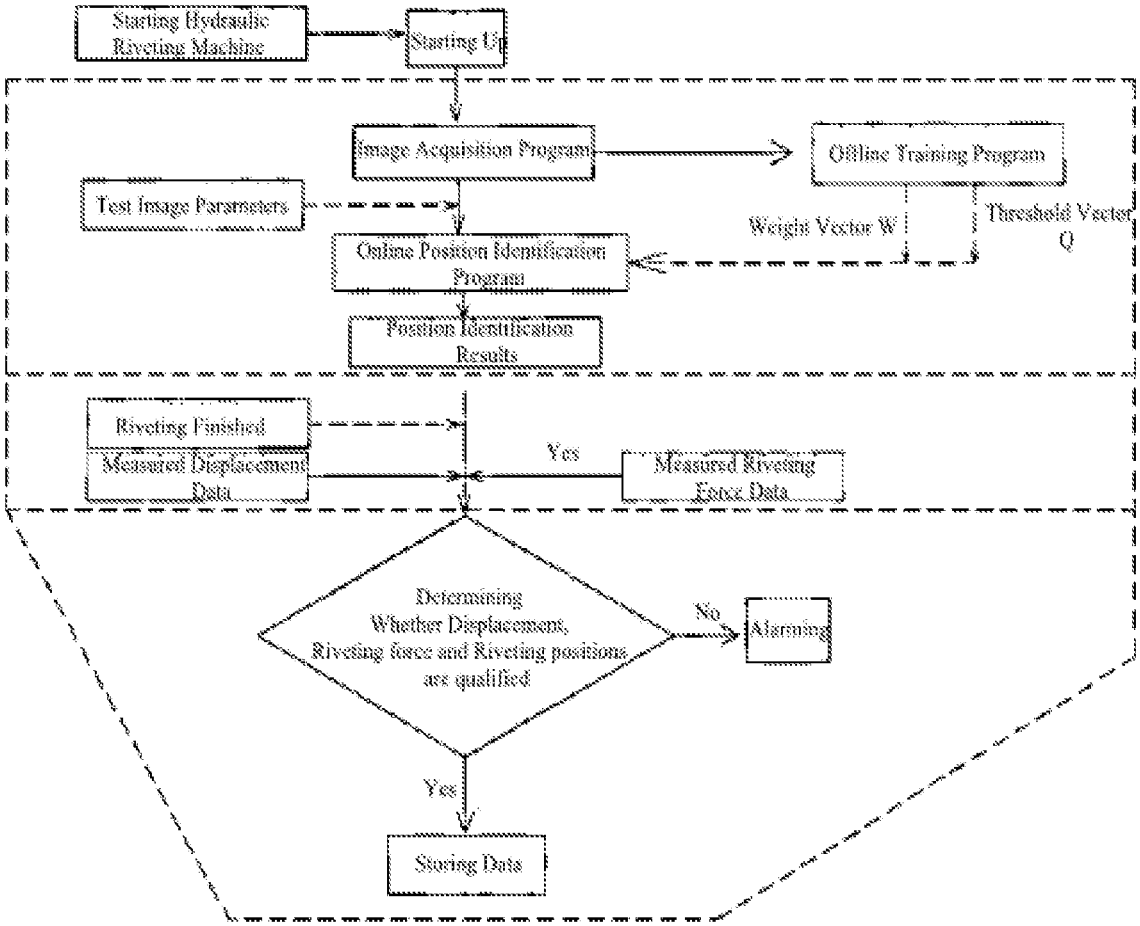
FIG. 2 is a flowchart of the intelligent riveting monitoring method.

Throughout the figures, 1 hydraulic riveting tool, 2 pulling rivet, 3 riveting plate, 4 displacement sensor, 5 pressure sensor, 6 camera device, 7 hydraulic pump station, 8 central processing system, 9 alarm, 1.1 oil cylinder, 1.2 piston, 1.3 anvil, 1.4 connecting sleeve, 1.5 hydraulic riveting tool pressure oil inlet, 2.1 rivet, 2.2 lantern ring, 2.1.1 rivet tail, 4.1 draw wire, 4*a* displacement sensor electrical signal line. 5*a* pressure sensor electric signal line, 5A through-shaft pressure sensor, 5Aa through-shaft pressure sensor signal line, 6*a* camera device signal line, B1 riveting curve threshold upper limit curve, B2 riveting curve threshold lower limit curve, X1 qualified riveting curve, X2 unqualified riveting curve.

DETAILED DESCRIPTION OF THE INVENTION

The present invention will now be described in detail by way of embodiments, which are provided for the purpose of further illustrating the invention only, and are not to be construed as limiting the scope of the invention, as non-essential modifications and adaptations thereof made by those skilled in the art are further within the scope of the invention.

References are made to the drawings hereafter.

The intelligent riveting system comprises an intelligent pump station and a hydraulic riveting tool. After the hydraulic riveting tool is started, the image acquisition device takes pictures of the riveting position point, and the image data are transmitted to the image acquisition and analysis system of the upper computer of the intelligent pump station for analyzing and processing, thereby completing the determination of the riveting position point. The piston and the jaw of the hydraulic riveting tool apply tension to the rivet, and the oil cylinder and the anvil assembly apply thrust to the lantern ring, so as to enable the displacement of the rivet relative to the lantern ring and fasten the riveted piece. In the riveting process, the riveting displacement acquired by the sensor on the hydraulic riveting tool or the flow pulse signal of the oil return port and the oil inlet of the pump station is transmitted to the upper computer of the intelligent pump station to directly or indirectly calculate the riveting displacement, and the riveting force data sensed by the pressure sensor on the pump station is transmitted to the upper computer to calculate the riveting force, so as to generate a riveting force-riveting displacement curve through a force-displacement acquisition and determination system. The riveting force-riveting displacement curve is compared and analyzed with the standard curve stored in the system to complete the determination of the riveting quality.

The invention also specifically comprises the following steps.

1) Configuration of the Intelligent Riveting Device

The hydraulic riveting tool is provided with the following image acquisition device, comprising a CCD industrial camera lens, a USB interface endoscope lens and a lens matched with a video capture card, wherein the video lens is fixedly mounted at the top of the outer surface of the oil cylinder of the hydraulic riveting tool through a mounting seat, the video lens is aligned with the riveted piece at the front position, and the signal line is transmitted from between the rear end cover of the hydraulic riveting tool and the anti-loosening baffle via a handle.

The following displacement sensor are arranged on the hydraulic riveting tool or the following flow meters are arranged on the intelligent pump station: the displacement sensor comprises a draw wire, rod or laser displacement sensor, and the acquired displacement signal can be transmitted to the upper computer to directly calculate the riveting displacement, with the draw wire, rod or laser displacement sensor body fixed on the rear end oil cylinder of the hydraulic riveting machine, the draw wire or the rod fixed on the piston of the hydraulic riveting machine, and a transmitter and a receiver for transmitting infrared rays to the piston arranged on the laser displacement sensor body to sense the displacement of the piston relative to the oil cylinder, namely the relative displacement of the rivet and the lantern ring in working state. The flowmeter is arranged between the oil return port of the intelligent pump station and the pressure oil outlet pipe of the hydraulic riveting tool or between the oil outlet port of the intelligent pump station and the pressure oil inlet pipe of the hydraulic riveting tool, for acquiring pulse signals of the pressure oil of the oil outlet pipe of the riveting tool and the oil inlet pipe of the riveting tool during each riveting, and the signal data are transmitted to the upper computer of the intelligent pump station to indirectly obtain the riveting displacement values.

The intelligent pump station is provided with the following pressure sensor: the pressure sensor is arranged between the oil outlet of the intelligent pump station and the pressure oil inlet pipe of the hydraulic riveting tool, with three ways respectively connected to the oil outlet of the hydraulic pump station, the hydraulic oil inlet pipe of the hydraulic riveting tool and the oil pressure sensing part of the pressure sensor, the sensing part of the pressure sensor acquires the real-time riveting oil pressure values, and the acquired data are transmitted to the force-displacement acquisition and determination system of the upper computer of the intelligent pump station to calculate and analyze the value of the real-time riveting force.

2) After the pulling rivet is preassembled on one side or both sides of the riveted piece, and after the rivet is inserted into the jaw at the front end of the hydraulic riveting tool, the riveting switch is pressed to start the hydraulic riveting tool.

3) The image acquisition device carries out image acquisition with the control time about 1 s, and the acquired image parameters are transmitted to the central processing system for comparing with the weight vector and the threshold vector obtained in the sample image parameters through an online position identification program, in order to obtain the position identification results and determine the position points.

4) After riveting is finished, the measured displacement and pressure related data are transmitted to the central processing system to generate a riveting force-displacement relation curve, and then comparison of the riveting force-displacement relation curve with the calibration riveting force-displacement relation curve in a database is performed.

5) The processing module of the central processing system determines whether the riveting force-displacement relation curve is qualified or not, and the identification module carries out sample identification on the riveting position, if qualified, storing the data into the storage, and if unqualified, driving the alarm and sending an alarm signal.

The intelligent riveting system of the invention is provided with the following image acquisition and identification system: the image acquisition and identification system carries out image acquisition on riveting points to be determined in a 360° range, and the acquired images are subjected to offline training to find out image characteristics of each position point and obtain a weight vector and a threshold vector, wherein the image identification is the process of processing the actually acquired images, and after the image characteristics are extracted, carrying out pattern identification on the characteristics by means of the classification standard or comparing the characteristics with the characteristic library to output the classification information.

The intelligent riveting system is provided with the following riveting system: during riveting, the pressure oil enters into the rod cavity of the oil cylinder piston from the oil inlet of the hydraulic riveting tool to apply thrust to the piston, the piston and the jaw apply tension to the rivet, and the oil cylinder and the anvil assembly apply thrust to the lantern ring, to enable the displacement of the rivet relative to the lantern ring and fasten the riveted piece; and during rivet removal, the pressure oil enters the rodless cavity of the oil cylinder piston from the oil return port of the hydraulic riveting tool to exert thrust on the piston, and the piston and the jaw exert thrust on the rivet, to loose the oil cylinder, the anvil assembly and the lantern ring, thereby finishing the rivet removal.

The intelligent riveting system is provided with the following force-displacement acquisition and determination system: in the riveting process, the pressure sensor acquires the output pressure of the hydraulic pump station at the oil outlet of the pump station; the flowmeter acquires the flow of the hydraulic oil during riveting at the oil return port and the oil outlet of the hydraulic station, or acquires the displacement data acquired by the draw wire, rod or lase displacement sensor; and the upper computer converts the acquired hydraulic oil information into displacement information and generates a "riveting pressure-displacement" curve. The riveting quality is determined by comparing the three parameters of "maximum pressure", "effective riveting displacement" and "riveting pressure-displacement curve" with the calibration data in the system.

The intelligent riveting system is provided with the following hydraulic control system: the hydraulic pump station completes normal riveting work by controlling an overflow valve, an electromagnetic reversing valve, an unloading valve, the pressure sensor and the pressure switch.

The image acquisition identification system comprises an offline training program and an online identification program.

The offline training program is written by using MATLAB to rapidly obtain required weight vectors and threshold vectors to train the offline neural network, wherein the riveting position images shot under actual working conditions are taken as training samples, with a plurality of images of each position; the sample image characteristic data are inputted into MATLAB through the data interface; and the weight vector and the threshold vector are obtained through normalizing the input values, constructing an output matrix, creating a network, and training the network.

The online identification program is written by LabVIEW. The characteristic parameter input of the test group image, the normalization of the test data, and the online recognition program generated by the test group data and the obtained weight vector and the threshold vector are operated according to the same algorithm as the offline training program. The statistical accuracy rate is calculated by the ratio of the correctly identified number of image positions to the total number of images corresponding to the test data.

When riveting is applied, a riveting button is started, so that the pressure oil enters the rod cavity of the oil cylinder piston from the oil inlet of the hydraulic riveting tool to apply thrust to the piston, the piston and the jaw apply tension to the rivet, and the oil cylinder and the anvil assembly apply thrust to the lantern ring, to enable the displacement of the rivet relative to the lantern ring. During rivet removal, the pressure oil enters the rodless cavity of the oil cylinder piston from the oil return port of the hydraulic riveting tool to exert thrust on the piston, and the piston and the jaw exert thrust on the rivet, to loose the oil cylinder, the anvil assembly and the lantern ring, thereby finishing the rivet removal.

In the riveting process, the pressure sensor acquires the output pressure electric signals of the hydraulic pump station at the oil outlet of the hydraulic station; the flowmeter acquires the hydraulic oil flow electric signals at the oil return port and the oil outlet of the hydraulic station; and the central processing system converts the acquired hydraulic oil flow electric signals into riveting displacement, and generates a "riveting pressure-displacement" curve. Whether the riveting process is qualified or not is determined through the central processing system by comparing the three parameters of "maximum pressure", "effective riveting displacement" and "riveting pressure-displacement curve" in the riveting process with the calibration data stored in the system.

As shown in FIG. 1, the riveting system comprises a hydraulic riveting tool 1, a pulling rivet 2 (the pulling rivet consists of a rivet and a lantern ring), a riveted piece 3, a riveted piece mounting hole 3A and a hydraulic pump station 7. After the hydraulic riveting machine is started, the piston 1.2 applies a backward tension to the rivet 2.1 through the jaw 1.2.1, and the oil cylinder 1.1 applies a forward thrust to the lantern ring 2.2 through the connecting sleeve 1.4 and the anvil assembly 1.3, so that the rivet is relatively displaced to the lantern ring, and the riveted piece 3 is fastened tightly.

The invention further comprises the following steps.

1) Configuration of the Riveting Monitoring System

The hydraulic riveting tool is provided with the following image acquisition device, comprising a CCD industrial camera lens, a USB interface endoscope lens and a lens matched with a video acquisition card, wherein the video lens is fixedly mounted at the top of the outer surface of the oil cylinder of the hydraulic riveting tool through the mounting seat, the video lens is aligned with the riveted piece at the front position, and the signal line is transmitted from between the rear end cover of the hydraulic riveting tool and the anti-loosening baffle via the handle.

The following displacement sensor are arranged on the hydraulic riveting tool or the following flow meters are arranged on the intelligent pump station: the displacement sensor comprises a draw wire, rod or laser displacement sensor, and the acquired displacement signals can be transmitted to the upper computer to directly calculate the riveting displacement, with the draw wire, rod or laser displacement sensor body fixed on the rear end oil cylinder of the hydraulic riveting machine, the draw wire or the rod fixed on the piston of the hydraulic riveting machine, and a transmitter and a receiver for transmitting infrared rays to the piston arranged on the laser displacement sensor body to sense the displacement of the piston relative to the oil cylinder, namely the relative displacement of the rivet and the lantern ring in working state. The flowmeter is arranged between the oil return port of the intelligent pump station and the pressure oil outlet pipe of the hydraulic riveting tool or between the oil outlet port of the intelligent pump station and the pressure oil inlet pipe of the hydraulic riveting tool, for acquiring pulse signals of the pressure oil of the oil outlet pipe of the riveting tool and the oil inlet pipe of the riveting tool during each riveting, and the signal data are transmitted to the upper computer of the intelligent pump station to calculate the real-time change of the hydraulic oil volume in the rod cavity and the rodless cavity of the oil cylinder of the hydraulic riveting tool during riveting, thereby calculating the numerical value of riveting displacement according to the effective areas of the piston with the rod cavity and the piston without the rod cavity of the oil cylinder of the hydraulic riveting tool.

The intelligent pump station is provided with the following pressure sensor: the pressure sensor is arranged between the oil outlet of the intelligent pump station and the pressure oil inlet pipe of the hydraulic riveting tool with three ways respectively connected to the oil outlet of the hydraulic pump station, the hydraulic oil inlet pipe of the hydraulic riveting tool and the oil pressure sensing part of the pressure sensor; the sensing part of the pressure sensor acquires the real-time riveting oil pressure values; and the acquired data are transmitted to the force-displacement acquisition and determination system of the upper computer of the intelligent pump station to calculate and analyze the value of the real-time riveting force.

Figure 3:
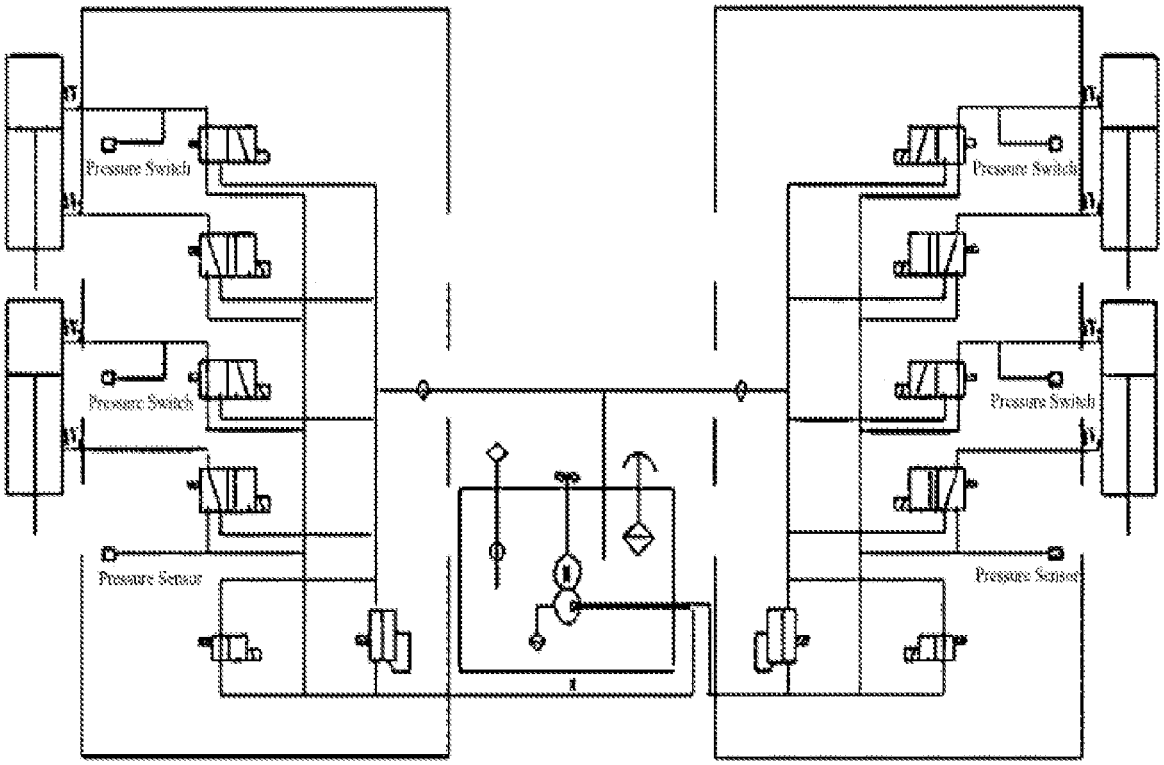
FIG. 3 is a schematic hydraulic control principle diagram.

2) Preassembling and riveting starting: after the rivet is preassembled on one side or both sides of the riveted piece, and after the rivet is inserted into the jaw at the front end of the hydraulic riveting tool, the riveting switch is pressed to start the hydraulic riveting tool, so that the jaw clamping flaps pull the rivet backwards, and the anvil pushes the pulling rivet lantern ring to move forwards for fastening. The hydraulic control principle in the whole riveting process is shown in FIG. 3.

3) Position identification: the image acquisition device carries out image acquisition with the control time not exceed 1 s, and the acquired images are transmitted, via the electric signal line of the image acquisition device, to the upper computer processing system for processing. After the image acquisition program is carried out by the processor, the test image parameters are transmitted into an online position identification program, the sample image parameters are inputted into an offline training program, and the obtained weight vector W and the threshold vector Q are also inputted into the online position identification program, so as to obtain the position identification results, namely outputting the riveting position identification information.

4) Comparison of the riveting displacement and the riveting pressure: the pressure electric signals acquired by the pressure sensor are converted into a digital signal and then transmitted the digital signal to the processing system of the upper computer, and the flow electric signals acquired by the flowmeter or the displacement data acquired by the draw wire, rod or laser displacement sensor are transmitted to the processing system of the upper computer, to form a "riveting pressure-displacement" curve. Whether the riveting displacement and the riveting force are qualified or not is determined by comparing the "maximum pressure", the "effective riveting displacement" and the "riveting pressure-displacement" curve in the riveting process with the calibration data stored in the system.

5) Determining and processing: the processor determines whether the displacement, the riveting force and the riveting position point are qualified or not, if qualified, storing the data into the storage of the central processing system, otherwise driving the alarm and sending an alarm signal.

The position identification is the process of acquiring the images of riveting position points based on the characteristics of different riveting positions, processing the actual acquired images to extract the image characteristics, and carrying out pattern identification on the characteristics by means of the classification standard or comparing the characteristics with the characteristic library to identify the riveting position points and output the classification information.

As shown in FIG. 3, the hydraulic pump station can simultaneously supply two paths of oil cylinders to work independently, two oil cylinders for each path (oil cylinders in different paths work independently, and oil cylinders in the same path work in an interlocked manner). After the hydraulic pump station is started, the oil pressure of the two paths rise, and the oil passage simultaneously reaches the overflow valve, the electromagnetic reversing valve and the unloading valve. When the unloading valve does not work, the connection oil passage returns to the oil tank; and when the unloading valve is powered to work, the oil passage flows through the oil cylinder loop. The oil pressure passes through a two-position three-way electromagnetic reversing valve. When YV1, YV2 and YV3 are all electrified, the pressure oil flows into the oil cylinder through the passage of YV2 to push the piston to move backwards; and when the pressure is greater than the set pressure of the pressure sensor, YV1 and YV2 are powered off, and the pressure oil flows into the oil cylinder through the passage of YV1 to push the piston to move forwards. When the oil return pressure is greater than the set pressure of the pressure switch, the YV3 is powered off, and the unloading valve is powered off and unloaded; and when the oil pressure of the oil passage is greater than the overflow pressure of the overflow valve, the overflow valve opens the passage in communication with the oil passage of the oil cylinder for unloading, so that the oil is kept at the overflow pressure value. When the unloading valves at the two paths are powered off at the same time, the motor is powered off and stops working.

Figure 4:
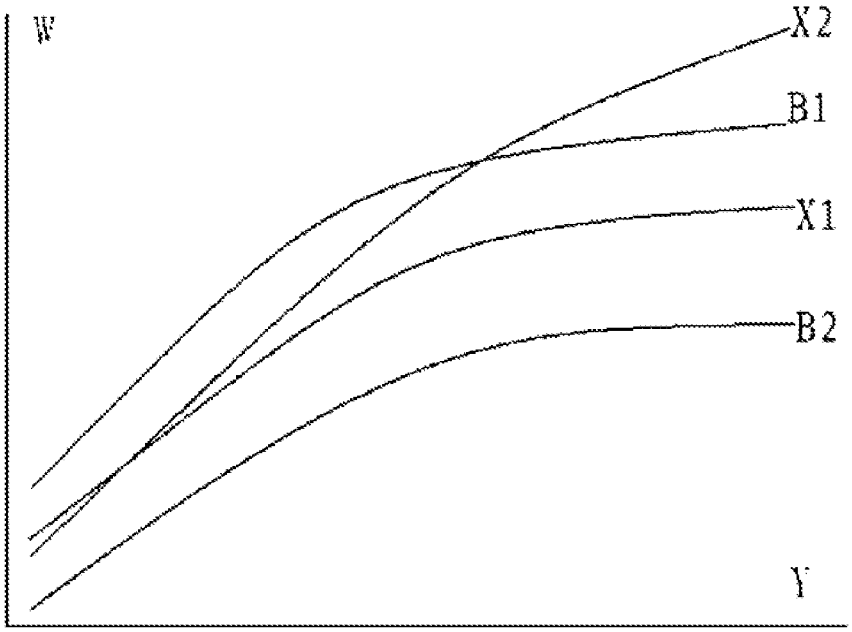
FIG. 4 is a schematic diagram of the monitoring method.

As shown in FIG. 4, a schematic diagram of the monitoring method is shown, wherein the abscissa Y is a pressure value, the ordinate is a displacement value, B1 and B2 are respectively standard value ranges set for the standard qualified curve, and X1 and X2 are respectively qualified riveting data and unqualified riveting data.

The invention claimed is:

1. An intelligent riveting system, comprising a hydraulic riveting tool, a riveting position identification system, a riveting displacement detection system, a riveting pressure detection system and a central processing system, wherein:

the hydraulic riveting tool comprises a riveting machine used for fixing a riveted piece through extruding a rivet, and a hydraulic pump station used for providing hydraulic riveting power for the riveting machine;

the riveting position identification system comprises an image acquisition device for acquiring image information of each riveting position and transmitting the image information to the central processing system;

the riveting displacement detection system comprises a displacement detection device for detecting real-time displacement data in the process of extruding the rivet to fix the riveted piece, and transmitting the real-time displacement data to the central processing system;

the riveting pressure detection system comprises a pressure sensor for detecting real-time riveting oil pressure data of the hydraulic pump station in the riveting process and transmitting the real-time riveting oil pressure data to the central processing system; and the central processing system comprises an upper computer, wherein the upper computer acquires image information from the image acquisition device and performs position identification, encoding and storage to form riveting position data in one-to-one correspondence; the upper computer acquires real-time displacement data from the riveting displacement detection system to form real-time displacement data in a time-sequential manner and stores the real-time displacement data; the upper computer acquires real-time riveting oil pressure data from the riveting pressure detection system to form real-time pressure data in a time-sequential manner and stores the real-time pressure data; and the upper computer records the position data, the displacement data and the oil pressure data into real-time data corresponding the riveting displacement values and riveting pressure values with each riveting position as a unit and in the same time-sequential manner.

2. The intelligent riveting system according to claim 1, wherein the displacement detection device is a draw wire, rod or laser displacement sensor.

3. The intelligent riveting system according to claim 1, wherein the displacement detection device comprises a flowmeter arranged between an oil return port of the hydraulic pump station and a pressure oil outlet pipe of the riveting machine or mounted between an oil outlet of the hydraulic pump station and a pressure oil inlet pipe of the riveting machine, wherein the flowmeter is used for acquiring a flow signal of the pressure oil of the oil outlet pipe of the riveting device or the pressure oil of the oil inlet pipe of the riveting device during riveting, and transmitting the flow signal data to the upper computer to obtain riveting displacement data.

4. The intelligent riveting system according to claim 1, wherein the image acquisition device adopts a CCD (charge coupled device) industrial camera lens, a USB interface endoscope lens or a lens matched with a video capture card, wherein the video lens of the image acquisition device is fixedly mounted at the top of the outer surface of the riveting device oil cylinder through a mounting seat; the video lens is aligned with the riveted piece at the front position; and a signal line is transmitted from between the rear end cover of the hydraulic riveting tool and an anti-loosening baffle through a handle.

5. The intelligent riveting system according to claim 4, wherein the central processing system compares the acquired real-time data corresponding to the riveting displacement values and the riveting pressure values (with each riveting position as a unit and in the same time-sequential manner) with a standard value range, recording these within the standard value range as qualified, otherwise recording as unqualified and sending a prompt message.

6. The intelligent riveting system according to claim 2, wherein the image acquisition device adopts a CCD (charge coupled device) industrial camera lens, a USB interface endoscope lens or a lens matched with a video capture card, wherein the video lens of the image acquisition device is fixedly mounted at the top of the outer surface of the riveting device oil cylinder through a mounting seat; the video lens is aligned with the riveted piece at the front position; and a signal line is transmitted from between the rear end cover of the hydraulic riveting tool and an anti-loosening baffle through a handle.

7. The intelligent riveting system according to claim 3, wherein the image acquisition device adopts a CCD (charge coupled device) industrial camera lens, a USB interface endoscope lens or a lens matched with a video capture card, wherein the video lens of the image acquisition device is fixedly mounted at the top of the outer surface of the riveting device oil cylinder through a mounting seat; the video lens is aligned with the riveted piece at the front position; and a signal line is transmitted from between the rear end cover of the hydraulic riveting tool and an anti-loosening baffle through a handle.

8. The intelligent riveting system according to claim 6, wherein the central processing system compares the acquired real-time data corresponding to the riveting displacement values and the riveting pressure values (with each riveting position as a unit and in the same time-sequential manner) with a standard value range, recording these within the standard value range as qualified, otherwise recording as unqualified and sending a prompt message.

9. The intelligent riveting system according to claim 7, wherein the central processing system compares the acquired real-time data corresponding to the riveting displacement values and the riveting pressure values (with each riveting position as a unit and in the same time-sequential manner) with a standard value range, recording these within the standard value range as qualified, otherwise recording as unqualified and sending a prompt message.

* * * * *